US008053403B2

(12) United States Patent
Abbas

(10) Patent No.: US 8,053,403 B2
(45) Date of Patent: Nov. 8, 2011

(54) CLEANING COMPOSITIONS

(75) Inventor: Laurent Abbas, Thurins (FR)

(73) Assignee: Arkema France, Colombes (FR)

( * ) Notice: Subject to any disclaimer, the term of this patent is extended or adjusted under 35 U.S.C. 154(b) by 0 days.

(21) Appl. No.: 13/122,896

(22) PCT Filed: Oct. 2, 2009

(86) PCT No.: PCT/FR2009/051881

§ 371 (c)(1),
(2), (4) Date: Apr. 6, 2011

(87) PCT Pub. No.: WO2010/043796

PCT Pub. Date: Apr. 22, 2010

(65) Prior Publication Data

US 2011/0195890 A1 Aug. 11, 2011

(30) Foreign Application Priority Data

Oct. 15, 2008 (FR) ..... 08 56985

(51) Int. Cl.
*C11D 7/50* (2006.01)

(52) U.S. Cl. ..... 510/407; 510/410; 510/412

(58) Field of Classification Search ..... 510/407, 510/410, 412

See application file for complete search history.

(56) References Cited

U.S. PATENT DOCUMENTS 6,660,709 B1 12/2003 Dournel et al.
6,743,765 B1 6/2004 Dournel et al.
6,770,614 B2 * 8/2004 Miller et al. ..... 510/411
6,951,835 B1 10/2005 Minor et al.
7,022,253 B2 4/2006 Dournel et al.
7,053,035 B2 * 5/2006 Hanada et al. ..... 510/407
7,189,339 B2 3/2007 Dournel et al.
7,270,717 B2 * 9/2007 Knopeck et al. ..... 134/34
7,429,557 B2 * 9/2008 Grzyll et al. ..... 510/407
7,517,845 B2 4/2009 Dournel et al.
7,531,496 B2 5/2009 Minor et al.
7,641,808 B2 * 1/2010 Schweitzer et al. ..... 252/67
7,960,331 B2 * 6/2011 Grzyll et al. ..... 510/407
7,998,916 B2 * 8/2011 Grzyll et al. ..... 510/407
2003/0171240 A1 * 9/2003 Hanada et al. ..... 510/407
2003/0224956 A1 * 12/2003 Miller et al. ..... 510/175
2004/0167053 A1 * 8/2004 Knopeck et al. ..... 510/405
2005/0267006 A1 12/2005 Minor et al.
2006/0166851 A1 * 7/2006 Grzyll et al. ..... 510/407
2009/0005282 A1 * 1/2009 Grzyll et al. ..... 510/161
2009/0026418 A1 * 1/2009 Grzyll et al. ..... 252/364
2009/0062170 A1 * 3/2009 Schweitzer et al. ..... 510/178
2009/0253820 A1 * 10/2009 Bowman et al. ..... 521/170
2009/0305876 A1 * 12/2009 Singh et al. ..... 502/150
2010/0108094 A1 * 5/2010 Ishikawa et al. ..... 134/6
2010/0190221 A1 * 7/2010 Herrema et al. ..... 435/135
2011/0037016 A1 * 2/2011 Singh et al. ..... 252/67
2011/0152152 A1 * 6/2011 Schweitzer et al. ..... 510/177

* cited by examiner

*Primary Examiner* — Gregory Webb
(74) *Attorney, Agent, or Firm* — Steven D. Boyd

(57) ABSTRACT

The subject of the invention is a composition comprising (i) from 10% to 25% by weight of 1,1,1,3,3-pentafluorobutane, preferably 16% to 24% by weight of 1,1,1,3,3-pentafluorobutane; (ii) from 62% to 70% by weight of trans-dichloroethylene, preferably from 63% to 68% by weight of trans-dichloroethylene, (iii) from 10% to 21% by weight of nonafluoromethoxybutane, preferably from 11% to 17% by weight of nonafluoromethoxybutane; and; (iv) from 1% to 4% by weight of nonafluoroethoxybutane, preferably from 2% to 4% by weight of nonafluoroethoxybutane. The subject matter of the invention is also to the use of said composition as a cleaning, solvent, degreasing, defluxing or drying agent.

6 Claims, No Drawings

CLEANING COMPOSITIONS

FIELD OF THE INVENTION

The subject of the invention is a cleaning composition based on halogenated hydrocarbons.

TECHNICAL BACKGROUND 1,1,2-Trichloro-1,2,2-trifluoroethane (F113) has been widely used in industry for cleaning and degreasing highly-varied solid surfaces (metal components, glasses, plastics, composites) for which the absence or at the very least the lowest possible residual content of impurities, in particular of organic origin, is required. F113 was particularly suitable for this use owing to its nonaggressive nature with regard to the materials used. This product was used in particular in the field of the fabrication of printed circuits, for removing the residues of the substances used to improve the quality of the soldered joints (denoted by the term solder flux). This removal operation is denoted in the trade by the term "defluxing".

Mention may also be made of the applications of F113 in the degreasing of heavy metal components and in the cleaning of mechanical components of high quality and of great accuracy, such as, for example, gyroscopes and military, aerospace or medical equipment. In its various applications, F113 is most commonly used in combination with other organic solvents (for example methanol), in order to improve its cleaning capacity.

F113 is also used in fields, in particular in optics, where it is required to have surfaces which are devoid of water, i.e. surfaces where water is only present in trace amounts undetectable by the measurement method (Karl Fisher method). F113 is, for this purpose, used in operations for drying (or dewetting) said surfaces, in combination with hydrophobic surfactants.

However, the use of F113-based compositions is now prohibited since F113 is one of the chlorofluorocarbons (CFCs) suspected of attacking or damaging stratospheric ozone.

Various solutions have been proposed for providing a replacement for F113, but which does not have the problems of destroying the ozone layer or of increasing the greenhouse effect. The greenhouse effect of a given product is quantified by its GWP (global warming potential) which takes into account the intrinsic effect of absorption of radiation by the molecule, but also the lifetime of the molecule in the atmosphere (or what amounts to its concentration for a considered period of time, most commonly one century). This GWP is given with respect to $CO_2$, taken as reference gas.

Document U.S. Pat. No. 6,770,614 describes compositions to replace F113, comprising in particular 1,1,1,3,3-pentafluoro-butane (365mfc), trans-dichloroethylene (tDCE), an ether such as nonafluoromethoxybutane (HFE7100) or nonafluoroethoxybutane (HFE7200), and also methylal and an alcohol. The amount of pentafluorobutane is described as being from 20% to 55, preferably from 25% to 50% by weight. The amount of trans-dichloroethylene is described as being from 40% to 70%, preferably from 53% to 62% by weight. The amount of ether is described as being less than 20%, preferably from 5% to 15% by weight. The minimum amount of methylal and/or of alcohol is not expressly mentioned, but the examples give an amount of approximately 1% by weight for methylal and approximately 1% by weight for the alcohol (isopropanol). The compositions according to that document have the drawback of being inflammable.

Document WO-A-00/36046 describes quite generally mixtures of pentafluoropentane and fluorinated ether, with optionally an organic solvent. Chlorinated solvents, such as trans-dichloroethylene, can be used as organic solvent.

Application WO-A-0056833 is directed toward cleaning compositions. This application describes mixtures of pentafluorobutane, trans-dichloroethylene and nona-fluoromethoxybutane. The amounts proposed (as % by weight) are in particular 1-98/1-64/1-75. Among the examples of such compositions, a mixture containing, as % by weight, 35% of pentafluorobutane, 64% of trans-dichloroethylene and 1% of nonafluoromethoxybutane is indicated. Application US20050267006, which is a continuation of the previous application, specifically claims quaternary mixtures of pentafluorobutane, trans-dichloroethylene, nonafluoromethoxybutane and isopropanol.

There is still a need for a cleaning composition as a replacement for F113, which is preferably more effective than the prior art compositions, in particular with regard to the precision cleaning and/or degreasing of metal components, and which is preferably non-inflammable and advantageously which remains non-inflammable when used in machines.

SUMMARY OF THE INVENTION

The invention therefore provides a composition comprising:

(i) from 10% to 25% by weight of 1,1,1,3,3-penta-fluorobutane;

(ii) from 62% to 70% by weight of trans-dichloro-ethylene;

(iii) from 10% to 21% by weight of nonafluoromethoxybutane;

(iv) from 1% to 4% by weight of nonafluoroethoxy-butane.

Preferably, the composition according to the present invention comprises (i) from 16% to 24% by weight of 1,1,1,3,3-pentafluorobutane; (ii) from 63% to 68% by weight of trans-dichloroethylene; (iii) from 11% to 17% by weight of nonafluoromethoxybutane and (iv) from 2% to 4% by weight of nonafluoroethoxybutane.

Advantageously, the composition according to the present invention does not comprise alcohol or methylal.

The invention also provides a composition consisting essentially of: (i) 10% to 25% by weight of 1,1,1,3,3-pentafluorobutane; (ii) 62% to 70% by weight of trans-dichloroethylene; (iii) 10% to 21% by weight of nonafluoromethoxybutane and (iv) 1% to 4% by weight of nonafluoroethoxybutane.

Preferably, the composition consists of:

(i) 16% to 24% by weight of 1,1,1,3,3-pentafluoro-butane;

(ii) 63% to 68% by weight of trans-dichloroethylene;

(iii) 11% to 17% by weight of nonafluoromethoxybutane; and (iv) 2% to 4% by weight of nonafluoroethoxybutane.

According to one embodiment, the composition contains up to 1% by weight of compounds other than methylal or alcohol, preferably up to 0.5% by weight, and advantageously up to 0.1% by weight.

The subject of the invention is also the use of the composition according to the invention as a cleaning, solvent, degreasing, defluxing or drying agent, preferably for the precision cleaning and/or degreasing of metal components.

DETAILED DESCRIPTION OF EMBODIMENTS

The invention uses the combination of four compounds, preferably in the absence in particular of compounds such as methylal and especially an alcohol. The presence of an alcohol is required in several compositions according to the prior art. The term "alcohol" used in the present invention is in particular directed toward linear or branched alkanols, containing up to 6 carbon atoms, the presence of said alkanols being preferably excluded in the present invention.

The components of the composition are known, and are commercially available. The ether used is available, for example, from 3M, under the trademark Novec®. The ether is available in the form of several isomers, such as 1,1,1,2,2,3,3,4,4-nonafluoro-4-ethoxybutane, 1,1,1,2,3,3-hexafluoro-2-(trifluoromethyl)-3-ethoxypropane, 1,1,1,3,3,3-hexafluoro-2-ethoxy-2-(trifluoro-methyl)propane, 1,1,1,1,2,3,3,4,4,4-nonafluoro-2-ethoxybutane, and 1,1,1,2,2,3,3,4,4-nonafluoro-4-methoxybutane, 1,1,1,2,3,3-hexafluoro-2-(trifluoro-methyl)-3-methoxypropane, 1,1,1,3,3,3-hexafluoro-2-methoxy-2-(trifluoromethyl)propane and 1,1,1,2,3,3,4,4,4-nonafluoro-2-methoxybutane.

These components can be mixed according to conventional techniques known to those skilled in the art.

The composition according to the invention comprises (i) from 10% to 25% by weight of 1,1,1,3,3-pentafluorobutane, preferably from 16% to 24% by weight of 1,1,1,3,3-pentafluorobutane; (ii) from 62% to 70% by weight of trans-dichloroethylene, preferably from 63% to 68% by weight of trans-dichloroethylene; (iii) from 10% to 21% by weight of nonafluoromethoxybutane, preferably from 11% to 17% by weight of nonafluoromethoxybutane; (iv) from 1% to 4% by weight of nonafluoroethoxybutane; preferably 2% to 4% by weight of nonafluoroethoxybutane.

Advantageously, the composition according to the present invention does not comprise alcohol or methylal.

According to one embodiment, the composition contains up to 1% by weight of compounds other than methylal or alcohol, preferably up to 0.5% by weight, and advantageously up to 0.1% by weight.

The composition may also contain up to 1% of other compounds, such as stabilizers or surfactants.

The stabilizers may be used to protect the compositions against the chemical attacks resulting from their contact with water (hydrolysis), or with light metals (constituting the solid surfaces to be cleaned), and/or against free-radical attacks that may occur in the cleaning processes. Mention may be made of nitroalkanes (in particular nitromethane, nitroethane, nitropropane) and ethers (1,4-dioxane, 1,3-dioxolane). The amount of stabilizer is less than 1%, typically from 0.1% to 0.5%. A stabilizer of which the boiling point is close to that of the final composition will be preferred.

Surfactants are useful, for example, in drying solutions. Any surfactant that is well known per se and compatible with the compositions according to the invention can be used.

Surfactants that can be used in the compositions according to the invention are described, for example, in Ullmann's Encyclopedia of Industrial Chemistry, 5th Ed., 1987, Vol. A8, p. 338-350. Cationic, anionic, nonionic and amphoteric surfactants may be used. Fatty acids, fatty esters, alkylbenzenesulfonates, alkanesulfonates, α-olefin sulfonates, α-sulfonated fatty acid esters (SESs), alkyl sulfates, alkyl ether sulfates, quaternary ammonium compounds, polyethylene glycol alkyl ethers, polyethylene glycol phenyl ethers, fatty acid alkanolamides, fatty alcohol polyglycol ethers, ethylene oxide/propylene oxide block copolymers, alkylbetaines, alkylsulfobetaines, tetraalkylammonium salts of mono- or dialkyl phosphoric acids, or surfactants comprising at least one imidazoline group can, for example, be used. Surfactants as described above containing at least one fluorine substituent can also be used. More specifically, surfactants comprising at least one polyfluorinated alkyl chain or one polyfluorinated aromatic substituent may be used. The amount of surfactant is between, for example, 0.05% and 0.5%, preferably between 0.1% and 0.3% by weight of the composition.

The compositions according to the invention have the advantage of not being inflammable.

Although methylal or alcohol are absent or substantially absent in certain compositions according to the invention, the cleaning properties are excellent.

Moreover, the compositions according to the invention have an advantage of remaining non-inflammable during use in industrial cleaning machines. The term "machines" is intended to mean any machine comprising at least two tanks, one of which serves to bring the cleaning compositions to boiling. The expression "remaining non-inflammable during use" is intended to mean that the cleaning composition vapors present in the machines do not ignite on contact with a flame.

In addition, the GWP values of the compositions according to the invention are very low, which is environmentally friendly.

The compositions according to the invention are useful for the same applications as those of F113. Thus, the compositions are therefore particularly suitable for use for cleaning and degreasing solid surfaces, for defluxing printed circuits (cleaning printed circuit boards contaminated with soldering flux and residues of this flux), and also for surface-drying operations (use as a drying agent for removing the water adsorbed at the surface of solid objects). These compositions will preferably be used for the precision cleaning and/or degreasing of metal components. The surfaces to be treated may be made of metal, plastic, glass or composite, and preferably of metal.

With regard to the modes of use, mention may in particular be made of use in devices suitable for cleaning and/or drying surfaces, which employ compositions that are liquid, and also by aerosol.

The compositions according to the invention are also useful as cooling compositions and heat-transfer fluids, extinguishing compositions, propellants, foaming agents, swelling agents, gaseous dielectrics, polymerization or monomer medium, support fluids, agents for abrasives, and fluids for power production units.

The following examples illustrate the invention.

EXAMPLES

Example 1

Inflammability During Use

The behavior of the various compositions in contact with a flame was determined when the compositions are used in various cleaning machines representative of the majority of the machines used industrially. The cleaning machines used are of the MEG brand. The first machine and the second machine have a system of cooling by means of a cold unit and comprise, respectively, 2 and 3 tanks. The third machine has 2 tanks but is cooled by water.

After operating for 20 h with each of the compositions of Table 1, the lid of the machines is opened and a flame is slowly introduced.

When the flame goes out in the 3 machines, it is declared that the composition does not burn.

When the vapors ignite on contact with the flame in at least one of the 3 machines, it is declared that the composition burns in machine.

| Composition | Percentage by weight (%) | | | | |
|---|---|---|---|---|---|
| | A | G | H | I | J |
| 365 mfc | 22 | 20 | 70 | 35 | 26 |
| TDCE | 63 | 70 | 20 | 64 | 62 |
| HFE 7100 | 11 | 5 | 10 | 1 | 7 |
| HFE 7200 | 4 | 5 | 0 | 0 | 5 |
| Comment | Does not burn | Burns in machine | Burns in machine | Burns in machine | Burns in machine |

Composition A is in accordance with the present invention. Compositions G, H, I and J are comparative compositions.

Example 2

Inflammability

The flashpoint of various cleaning compositions was determined on a Setaflash apparatus and according to the standard conditions described by standard ASTM D 3828 and in the temperature range −26° to +50° C. The inflammability in air of the compositions was evaluated by bringing a few centiliters of these cleaning solutions into contact with a flame. If the solution ignites, the period of time for which a flame is present is recorded.

The results are given in Table 2.

| Composition | Percentage by weight (%) | |
|---|---|---|
| | A | G |
| 365 mfc | 22 | 20 |
| TDCE | 63 | 70 |
| HFE 7100 | 11 | 5 |
| HFE 7200 | 4 | 5 |
| Flashpoint (° C.) | No | −19° C. |
| Period of time for which the flame is present in the dish (s) | No inflammability | >2 |

Example 3

Degreasing

Polished and pre-cleaned stainless steel (type 316L) test pieces having the dimensions 30×10 mm were weighed with an accuracy of 0.1 mg. A small amount of commercial petroleum jelly was deposited at the surface of these test pieces. The test pieces thus covered with oil were weighed once again and the weights obtained correspond to what will be referred to below as starting weight. Once the starting weight has been determined, each test piece is immersed for 5 min in a beaker containing a cleaning composition maintained at ambient temperature, and then dried in the open air for 5 min. After this treatment, the test pieces are again weighed in order to determine the percentage of each oil removed.

TABLE 3

| Composition | Tare (g) | Weight sheet with oil (g) | Weight dry sheet (g) | Percentage of oil removed (%) | Mean (%) |
|---|---|---|---|---|---|
| H | 5.2806 | 5.3368 | 5.3303 | 11.6 | 11.7 |
| | 5.4989 | 5.611 | 5.5969 | 12.6 | |
| | 5.3086 | 5.3763 | 5.3689 | 10.9 | |
| I | 2.0347 | 2.0629 | 2.0348 | 99.6 | 94.2 |
| | 2.1473 | 2.1971 | 2.1553 | 83.9 | |
| | 2.1521 | 2.1884 | 2.1524 | 99.2 | |
| A | 5.4802 | 5.5349 | 5.4844 | 92.3 | 96.8 |
| | 5.7453 | 5.8127 | 5.7465 | 98.2 | |
| | 5.3087 | 5.3595 | 5.3087 | 100 | |

Example 4

Degreasing of Lubricating Oil

The procedure is carried out as in Example 1, but with a lubricating grease used in the aeronautical industry.

The results are given in Table 4.

TABLE 4

| Composition | Tare (g) | Weight sheet with oil (g) | Weight dry sheet (g) | Percentage of oil removed (%) | Mean (%) |
|---|---|---|---|---|---|
| H | 5.7454 | 5.833 | 5.831 | 2.3 | 1 |
| | 5.3087 | 5.3796 | 5.3791 | 0.7 | |
| | 5.7489 | 5.8296 | 5.8296 | 0.0 | |
| I | 2.1525 | 2.2294 | 2.1632 | 86.1 | 88.6 |
| | 2.0351 | 2.0973 | 2.0436 | 86.3 | |
| | 2.2385 | 2.2981 | 2.2425 | 93.3 | |
| A | 5.498 | 5.5803 | 5.5093 | 86.3 | 84.1 |
| | 5.4793 | 5.5841 | 5.5068 | 73.8 | |
| | 5.2801 | 5.3759 | 5.2874 | 92.4 | |

Example 5

Global Warming Potential (GWP)

The global warming potential (GWP) over a period of 100 years was calculated, taking as reference: GWP ($CO_2$)=1.

The GWP of composition H is 670 and that of composition A is 476.

Example 6

The procedure is carried out as in Example 3, but with a composition containing 10% by weight of 365 mfc, 69% by weight of TDCE, 19% by weight of HFE 7100 and 2% by weight of HFE 7200.

The percentage of liquid petroleum jelly removed is 98.5%.

Example 7

The procedure is carried out as in Example 4, but with the composition as described in Example 5.

The percentage of lubricating oil removed is 93.2%.

The composition used for Examples 6 and 7 does not have a flashpoint (standard ASTM D3828) and does not burn in machine.

The invention claimed is:

1. A composition comprising (i) from 10% to 25% by weight of 1,1,1,3,3-pentafluorobutane; (ii) from 62% to 70% by weight of trans-dichloroethylene; (iii) from 10% to 21% by weight of nonafluoromethoxybutane; (iv) from 1% to 4% by weight of nonafluoroethoxybutane, preferably from 2% to 4% by weight of nonafluoroethoxybutane.

2. The composition as claimed in claim 1, characterized in that the 1,1,1,3,3-pentafluorobutane is present in a proportion of 16% to 24% by weight.

3. The composition as claimed in claim 1, characterized in that the trans-dichloroethylene is present in a proportion of 63% to 68% by weight.

4. The composition as claimed in claim 1, characterized in that the nonafluoromethoxybutane is present in a proportion of 11% to 17% by weight.

5. The composition as claimed in any claim 1, characterized in that it consists essentially of 1,1,1,3,3-pentafluorobutane, trans-dichloroethylene, nonafluoromethoxybutane and nonafluoroethoxybutane.

6. The use of the composition as claimed in claim 1, as a cleaning, solvent, degreasing, defluxing or drying agent.

* * * * *